United States Patent [19]

Tikhonov et al.

[11] 4,288,889

[45] Sep. 15, 1981

[54] APPARATUS FOR DRAFTING FIBERS

[76] Inventors: Valentin N. Tikhonov, ulitsa Sh. Rustaveli, 55, kv. 28; Vitaly I. Zhestkov, Chilanzar, kvartal 19, dom 26, kv. 41; Gennady N. Shlykov, Chilanzar, kvartal 19, dom 31, kv. 3; Vasily M. Diachkov, Chilanzar, kvartal 7, dom 18"V", kv. 8; Viktor M. Mukhin, ulitsa B. Khmelnitskogo, 69, korpus 5, kv. 31; Gennady V. Zhigalov, ulitsa Bogdana Khmelnitskogo 69, korpus 2, kv. 6, all of Tashkent, U.S.S.R.

[21] Appl. No.: 72,674

[22] Filed: Sep. 5, 1979

[51] Int. Cl.[3] ..... D01H 5/74

[52] U.S. Cl. ..... 19/236; 19/258

[58] Field of Search ..... 19/236, 258

[56] References Cited

U.S. PATENT DOCUMENTS

| | | | |
|---|---|---|---|
| 709,694 | 9/1902 | Bietenholz | 19/258 |
| 1,994,176 | 3/1935 | Fossel | 19/258 |
| 2,853,847 | 9/1958 | Keeler et al. | 19/236 X |

FOREIGN PATENT DOCUMENTS

| | | | |
|---|---|---|---|
| 1033490 | 7/1953 | France | 19/258 |
| 2189548 | 1/1974 | France . | |
| 8777 | of 1887 | United Kingdom | 19/258 |
| 852449 | 10/1960 | United Kingdom | 19/236 |

*Primary Examiner*—Louis Rimrodt

*Attorney, Agent, or Firm*—Fleit & Jacobson

[57] ABSTRACT

The invention contemplates a method for separating fibers fed in the form of fibrous material, wherein the material is pinched in the cross-section in such a manner that the pinching action is applied to fibers spaced from one another at a certain distance. Simultaneously, the velocity of fibrous material is substantially increased so that individual fibers are pulled out. An apparatus for carrying out the method comprises an outlet pair of rolls having an appropriately profiled cylindrical roll.

5 Claims, 12 Drawing Figures

APPARATUS FOR DRAFTING FIBERS

The invention relates to textile machines, and more particularly, to spinning machines, and namely to method and apparatus for isolating fibers of a fibrous material in the open-end spinning.

It is known that in the open-end spinning process a starting fibrous material is fed in the form of a fibrous mass comprising a band or roving in which longitudinally oriented fibers are held together by cohesion forces.

These fibers should, however, be separated and isolated (singled-out) for admission to a spinning chamber of a spinning machine where individual fibers are interconnected and spun to form yarn. Quality of yarn depends on the quality of isolation of roving fibers, that is on the possibility of creating a flow of fibers at high degree of speration, the degree of separation depending on the number of individual fibers per unit of volume. This is to be understood in a way that the highest degree of separation corresponds to complete separation into individual fibers. In case a separated batch includes several fibers, the degree of separation is lower, and, as mentioned above, the quality of yarn is worse as a result of unevenness as it will be explained below.

Accordingly, those skilled in the art of textile machines paid much attention to so called drafting mechanisms ensuring separation of fibers of a starting fibrous material.

The drafting mechanisms of this type are based on the same principle consisting in that a moving fibrous material is pinched along one or several lines at a right angle to the flow direction, the lines being spaced from one another, and the velocity of movement of the fibrous material in each successive line is increased.

Fibers or groups of fibers to which a greater velocity is imparted are isolated from the mass of fibrous material and then transferred to a spinning chamber. One of widely known drafting mechanisms comprises a pair of feeding rolls including two rolls and feeding a fibrous material to an outlet pair of rolls where the fibers are separated. The outlet pair of rolls comprises a smooth cylinder and a pressure roll which rotate at the same speed which is many times greater than the speed of the pair of feeding rolls. Fibrous material is pinched along the line of contact of the cylinder and roll, and, owing to a greater rotary speed of the outlet rolls, fibers are isolated from the mass. As mentioned above, the pinching takes place along the line of contact of the cylinder and roll, whereby groups or bunches of fibers are inevitably isolated, rather than individual fibers, which, as mentioned, results in impaired quality of resultant yarn. It should be also born in mind that, since it is even impossible to isolate equal groups of fibers, the resultant yarn is non-uniform lengthwise.

The main problem was, therefore, to improve the degree of separation, and the problem was partially solved in a drafting mechanism disclosed in French Pat. No. 2,189,548, Cl. D 01 H 5/00, which was basically similar to the above-described mechanism with the only difference that the cylinder was profiled by making a plurality of parallel helical grooves on its surface.

Provision of helical grooves on the cylinder periphery results in that the pinching line of the pressure roll and cylinder becomes discontinuous, hence not all fibers along the width of the fibrous material being fed get pinched along the generatrix lines of the pressure roll and cylinder, but rather a part of them. The number of pinched fibers is determined by the area of contact of the roll and cylinder or by the width of the helical grooves. The drafting mechanisms of this type have, however, the following disadvantage. Projections provided along helical line on the cylinder separate the fibers in a sequence from one extremity to the other. Thus, non-uniformity of the number of fibers over the cross-section of the fibrous material results in non-uniform feeding of fibers to the zone of yarn formation in the subsequent spinning.

It is an object of the invention to provide method and apparatus to ensure high degree of separation of fibers of a starting fibrous material for open-ended spinning machines.

Another object of the invention is to provide an outlet pair of rolls of the drafting mechanism which ensures the separation into mainly individual fibers.

Among other objects there is an improvement of quality of product owing to increased degree of separation of fibers and improvement of spinning stability.

These and other objects are accomplished by that in a method for isolating fibers of a fibrous material in the open-end spinning, comprising feeding a fibrous material from a feeding pair of rolls to an outlet pair of rolls in which the fibers are pinched in the cross-section of the material being handled, and individual fibers are pulled out as they move, with simultaneous increase in the fiber velocity, according to the invention, the fibers are pinched in such a manner that the pinching action is simultaneously applied to fibers spaced from one another at a distance of at least 200 times the thickness of fibers.

The invention is advantageous in that, since the fibers are simultaneously pulled out at points separated from one another by a distance of at least 200 times the thickness of fibers, the degree of separation of fibers and their isolation are improved thus resulting in reduced non-uniformity of resultant yarn and stabilization of spinning as it will be shown later.

For carrying out the above-described method, the use is made of a drafting mechanism, comprising a pair of feeding rolls and a pair of drafting rolls including a profiled cylinder and a pressure roll cooperating along generatrix lines and defining a zone of pinching of a fibrous material for isolating individual fibers, the rotary speed of the drafting pair of rolls being many times greater than the rotary speed of the pair of feeding rolls, and, according to the invention, in this mechanism the outer periphery of the profiled cylinder of the outlet pair of rolls is formed by alternating projections arranged at the intersection points of helical lines, one group of helical lines including a plurality of parallel righthand helical lines and the other group of lines including a plurality of parallel lefthand helical lines, the ratio between the angles of inclination of the helical lines to the generatrix of the roll being from 1.0 to 1.8, and with the ratio of 1.0 the spacing of the projections along the righthand helical lines being greater or smaller than the spacing of the projections along the lefthand helical lines.

The invention is advantageous in that it ensures a guaranteed pinching of fibers independent of the location of a fiber in the fibrous material being fed owing to an overlap of surfaces of projections in one row by the surfaces of projections of another row, thus improving the parallelism of separated fiber at the outlet of the drafting pair of rolls. The distance between the projections (spacing of the projections) in contact with the pressure rolls, which are located along one and the same generatrix line of the cylinder is of at least 200 times the thickness of fiber.

This arrangement of the projections enables a simultaneous separation of fibers spaced from one another at a distance of at least 200 times the thickness of fiber, whereby the degree of separation of fiber is improved.

Each helical line along which the projections are arranged is made with an angle of inclination of 45° to 80°.

This enables an increase in the number of points in contact and thereby an improvement of the degree of separation of fibers.

Another distinction of the outlet pair of rolls resides in that the total area of the projections is 0.04 to 0.2 of the area of the cylindrical surface of the cylinder.

This ratio of the total area of the projections to the area of the cylindrical surface prevents pulling out of groups or bunches of fibers thereby contributing to an improvement of spinning.

The projections on the outer periphery of the cylinder may be of different shapes. The shape of the projection depends on the size of fibers being separated, degree of their straightness, greasing and contamination. The width of the surface of contact of one projection with the pressure roll along the generatrix of the roll is maximum 0.2 times the distance between the projections arranged along this generatrix.

The invention will now be described with reference to specific embodiments illustrated in the accompanying drawings, in which:

FIG. 1 schematically shows a drafting mechanism according to the invention, with the cylinder of the outlet pair of rolls being shown partially in section;

Figure 1:
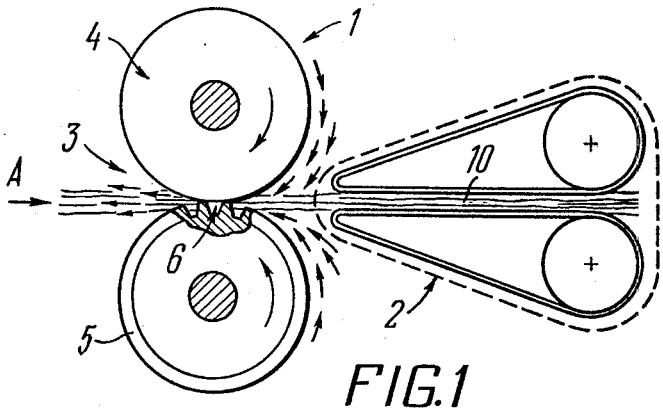

Referring to FIG. 1, a drafting mechanism according to the invention is shown generally at 1. The drafting mechanism comprises a feeding pair of rolls 2 and an outlet pair of rolls 3. As in any conventional drafting mechanism, the feeding pair of rolls comprises a feed roll and a pressure roll (not shown). The outlet pair of rolls 3 comprises a pressure roll 4 and a profiled cylindrical roll or cylinder 5.

Figure 2:
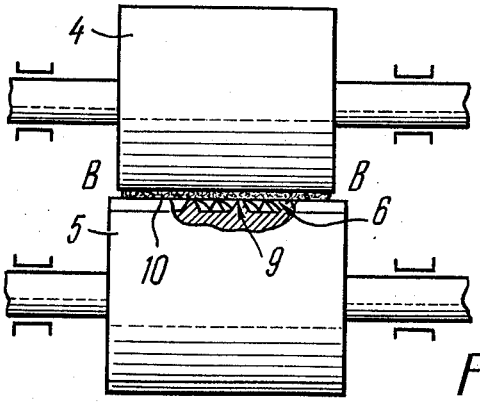
FIG. 2 is a view of the outlet pair of rolls taken along arrow A in FIG. 1.

It can be seen in FIG. 2 that the roll 4 and the cylindrical roll 5 are mounted for engaging one another along their generatrix line BB.

Figure 3:
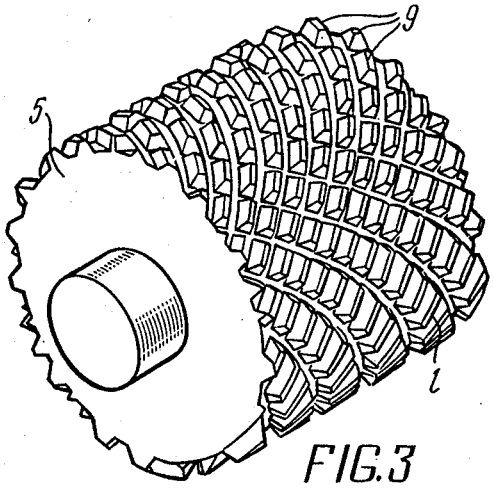
FIG. 3 is a perspective view of the cylinder of the outlet pair of rolls.
Figure 4:
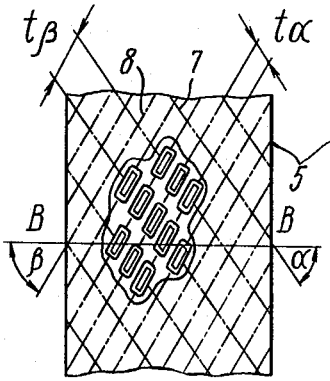
FIGS. 4, 6, 8, 10 are developed views of the working surface of the cylinder of the outlet pair of rolls with projections of different shapes.

The profiled cylindrical roll may be obtained, e.g. by milling a starting smooth roll to produce a plurality of grooves 6 and projections which are arranged at intersection points of righthand helical lines 7 and lefthand helical lines 8. As shown in FIGS. 3 and 4, projections 9 form two groups. One group includes the projections arranged with a spacing $t\alpha$ along the righthand helical lines 7 with an angle of inclination $\alpha$, and the other group includes the projections arranged with a spacing $t_\beta$ along the lefthand helical lines 8 at an angle of inclination $\beta$.

The angle of inclination of each helical line (angle of inclination of the projections), that is the angle between the generatrix and a tangent line at a given point in the direction of the helical pitch is within the range from 45° to 80°, and the ratio of angles of inclination of the helical lines of different hands is from 1.0 to 1.8. This provides for an improved straightness of fibers owing to better conditions for air passage between the projections and to the elimination of lateral displacement of the air flow together with the fibers.

As shown in FIG. 4, at equal angle of inclination $\alpha$ and $\beta$ of the helical lines 7, 8 of different hands, the spacings of the projections 9 $t_\alpha$ and $t_\beta$ should be different, because otherwise the projections would run in parallel rows along the circumference. Thus the adjacent rows of the projections will either have common planes extending at right angle to the roll axis, or define interstices in the form of annular grooves. In the former case the action of the roll over the width of the fibrous material will not be uniform and result in unevenness of the yarn, and in the latter case the separation process becomes impossible. As shown in FIG. 2, at the points of engagement of the projections 9 and the pressure roll 4 fibers of a starting fibrous material 10 are pinched and separated.

In case the angle of pitch of the helical grooves is smaller than 45° the length l of the projection 9 becomes so large that the flow of discrete fibers becomes non-uniform resulting in non-uniformity of fibers over the width of the fibrous material.

In case the angle of pitch is greater than 80° the length l of the surface of the projection becomes so big transversely of the generatrix line that the flow of discrete fibers becomes non-uniform resulting in non-uniformity of fibers along the length of the fibrous material.

Total area of all projections arranged on the cylindrical surface of the roll in contact with the pressure roll, defining the pinching zone therewith is 0.04 to 0.2 of the area of working surface of the cylinder.

In case the total area of the surface of projections in contact with the pressure roll is smaller than 0.04 of the area of the working surface of the cylinder the fibers would be insufficiently pinched and would slip at the moment of their separation.

In case the total area of surfaces of the projections in contact with the pressure roll is greater than 0.2 of the area of the working surface of the cylinder, bunches or groups of fibers are separated.

The projections of the outer periphery of the roll as shown in FIG. 3 are arranged in such a manner that the distance therebetween along the generatrix of the roll is of at least 200 times the thickness of fibers of the material being handled. Therefore, the projections act on a fibrous band not simultaneously over the entire line of contact of the outlet pair of rolls, but they alternately pull individual fibers out at different points spaced from one another at a distance of at least 200 times the thickness of fibers. The projections of the outer periphery of the cylinder may be of different shapes.

Figure 5:
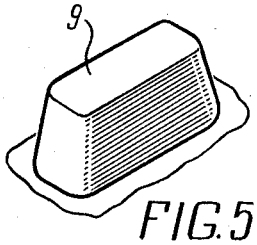
FIGS. 5, 7, 9, 11 show projections of different shapes corresponding to the developed views.

FIG. 5 shows an individual projection for the embodiment shown in FIG. 4. This projection may be described, as a whole, as a trough-shaped projection having a relatively large area of contact with fibers being separated.

Figure 6:
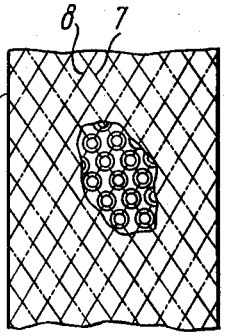
Figure 7:
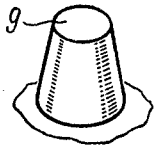

FIG. 7 shows an individual projection for the embodiment shown in FIG. 6. This projection may be described as a frustoconical projections having its smaller base in contact with the pressure roll during the separation of fibers.

Comparing the embodiments of the projection shown in FIGS. 5 and 7 it is noted that the projections shaped as truncated pyramid are more preferable in handling coarser and thicker fibers, and the conical projections are advantageous for relatively fine fibers.

Figure 8:
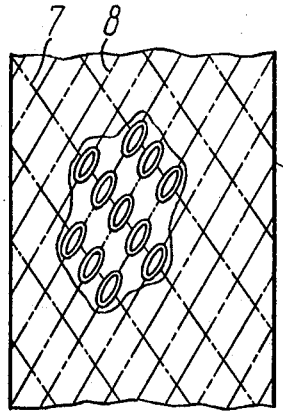
Figure 9:
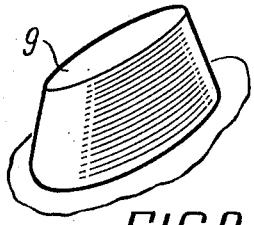

FIG. 9 shows an individual projection corresponding to the embodiment shown in FIG. 8. This projection may be described as a whole as a projection with the upper flat base of an oval from, which is in contact with the pressure roll during the separation of fibers, and the periphery of the projection enlarges downwards. This projection is preferably used for greased fibers and fibers containing impurities and extraneous matter.

Figure 10:
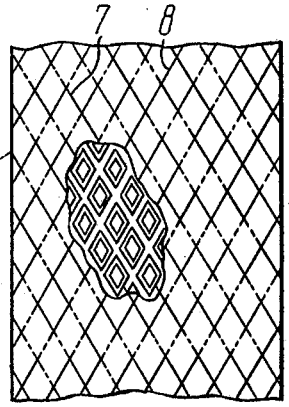
Figure 11:
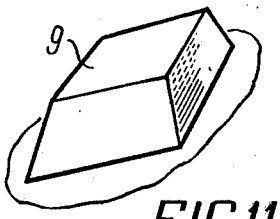

FIG. 11 shows an individual projection corresponding to the embodiment shown in FIG. 10. This projection may be described as a projection in the form of a prismatoid with the periphery defined by a combination of trapeziums. The outlet pair of rolls with the cylinder periphery having such projections may be used for any kind of natural or synthetic fibers. The outer periphery of a cylinder having such projections is the simplest for manufacture.

In using any of the above-described shapes of projections it is expedient that the width of the projection surface along the generatrix of the roll which is not in contact with the fibers should not exceed 0.2 times the distance between the projections arranged along this generatrix. It is best shown in FIG. 12.

Figure 12:
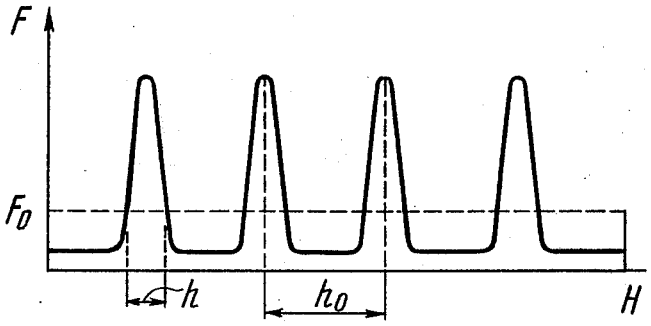
FIG. 12 is a diagram showing distribution of friction forces in the pinching zone of the outlet pair of rolls of the drafting mechanism.

FIG. 12 is a diagram showing fields of friction forces in the pinching zone of the outlet pair of rolls of the drafting mechanism. Friction forces are plotted on the ordinates and the width of the starting fibrous material is plotted on the abscissa.

Dotted line $F_o$ in FIG. 12 shows minimum force required to pull out fibers from the mass of the starting fibrous material.

It can be seen in FIG. 12 that the width h of the surface of contact of the projection and the pressure roll does not exceed 0.2 times the distance between the projections. An increase in the width may result in pulling out by the projection of a group of fibers, which will entrain groups of fibers between the projections thereby causing non-uniformity of the isolation process.

The distance $h_o$ between maximum picks in the diagram depends on the distance between the simultaneously pinched fibers in the flow of fibrous material, and this distance is of at least 200 times the thickness of fibers.

The above described outlet pair of rolls functions substantially similarly to the conventional pairs of rolls, the main attention being drawn only to some features of the pair of rolls according to the invention.

A drive (not shown) rotates the cylinder 5 of the outlet pair of rolls 3. The pressure roll 4 in contact with the cylinder also rotates. The fibrous material 10 leaving the feeding pair of rolls 2 is fed to the outlet pair of rolls 3 where fibers are pinched. Owing to the fact that the surface of the cylinder of the outlet pair of rolls has the projections 9 in contact with the roll 4, not all fibers get pinched. The pinched fibers are given the linear velocity of the outlet pair of rolls 3 which is greater than the velocity of the feeding pair of rolls 2 so that the fibrous material is pulled out and separated.

The projections 9 displaced relative to one another along intersecting lines act on the fibrous material 10 not simultaneously but selectively at different points along the width of the fibrous material. The fibers pinched by the projections 9 are pulled out from the fibrous material 10 and fed to a spinning chamber (not shown). The fibers which get to the helical grooves 6 move at a speed of the feeding pair of rolls until they get pinched between the projections 9 and the pressure roll 4.

The use of the invention provides for the production of high-grade yarn owing to improved separation of fibers.

We claim:

1. An apparatus for isolating fibers of a fibrous material and for feeding isolated fibers to a subsequent operation comprising: a feeding pair of rolls; and an outlet pair of rolls, the outlet pair of rolls including a cylindrical roll with a profiled peripheral surface and a pressure roll in contact with said cylindrical roll along generatrix lines to define a zone of pinching of the fibrous material for isolating individual fibers, linear velocity of said outlet pair of rolls being many times greater than the linear velocity of said feeding pair of rolls, and said profiled peripheral surface being formed by alternating spaced projections arranged at points of intersection of helical lines, one group of said helical lines including a plurality of parallel righthand helical lines, and another group of said helical lines including a plurality of parallel lefthand helical lines, the ratio of angles of inclination of these lines to the generatrix of the roll being from 1.0 to 1.8, and the spacing of the projections along the righthand helical lines being different from the spacing of the projections along the lefthand helical lines when the ratio is 1.0.

2. An apparatus according to claim 1, wherein the distance between said projections which are in contact with said pressure roll and extend along one and the same generatrix line is of at least 200 times the thickness of fibers.

3. An apparatus according to claim 2, wherein the width of the part of the surface of said projection in contact with the fiber along said generatrix of the roll does not exceed 0.2 of the distance between the projections arranged along said generatrix.

4. An apparatus according to claim 1, wherein said angle of inclination of said helical lines ranges from 45° to 80°.

5. An apparatus according to claim 1, wherein the area of said projections in contact with the pressure roll ranges from 0.04 to 0.2 of the area of the cylindrical surface of said pressure roll.

* * * * *